US008002671B1

(12) United States Patent
Vigilia et al.

(10) Patent No.: US 8,002,671 B1
(45) Date of Patent: Aug. 23, 2011

(54) SUPINE ELEVATION CYCLE

(76) Inventors: Larry Vigilia, Glendale, CA (US); Kerry Michael Kilbride, La Canada-FLT, CA (US)

( * ) Notice: Subject to any disclaimer, the term of this patent is extended or adjusted under 35 U.S.C. 154(b) by 24 days.

(21) Appl. No.: 12/798,099

(22) Filed: Mar. 31, 2010

(51) Int. Cl.
*A63B 71/00* (2006.01)
*A63B 26/00* (2006.01)

(52) U.S. Cl. ..... 482/5; 482/142; 482/143

(58) Field of Classification Search ..... 482/1–9, 482/92–100, 140, 142, 148, 900–902; 434/247
See application file for complete search history.

(56) References Cited

U.S. PATENT DOCUMENTS 5,058,888 A * 10/1991 Walker et al. ..... 482/8
2004/0018923 A1* 1/2004 Schiff ..... 482/142
2006/0128535 A1* 6/2006 Smith ..... 482/94
* cited by examiner

*Primary Examiner* — Glenn Richman
(74) *Attorney, Agent, or Firm* — John L. Sotomayor

(57) ABSTRACT

The Supine Elevation Cycle is uniquely designed to provide multiple levels of physical therapy, or if desired, a vigorous and effective cardiovascular workout while minimizing painful and damaging physical impact on the body's major joints. The SEC features an elevated cycling device whereby the user exercises in a supine or reclined position while pedaling with the lower extremities positioned above the level of the heart. This results in a transfer of weight bearing stress from major joints to the large muscles in the calves, thighs, abdomen and back. With an adjustable back support, the user, utilizing the extension and angling features of the cycling device, can target numerous muscle groups of the body and extremities. Additional supine or upright positions with proper adjustment of the apparatus allow the targeting of muscle groups in the arms, shoulders, chest and back. Magnetic resistance in the exercise operation assembly affords a wide range of cycling resistance, from light stretching or controlled muscle therapy, to the most intense cardiovascular workout.

20 Claims, 9 Drawing Sheets

SUPINE ELEVATION CYCLE

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

The benefits of exercise for post operative patients are widely accepted by the medical community for the acceleration of physiological recovery and providing physiological benefits beyond mere recovery. However, even mild exercise is often difficult for some patients in a post operative recovery period because of severe discomfort from stress on the spine, as well as hip, knee and foot joints.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1A:
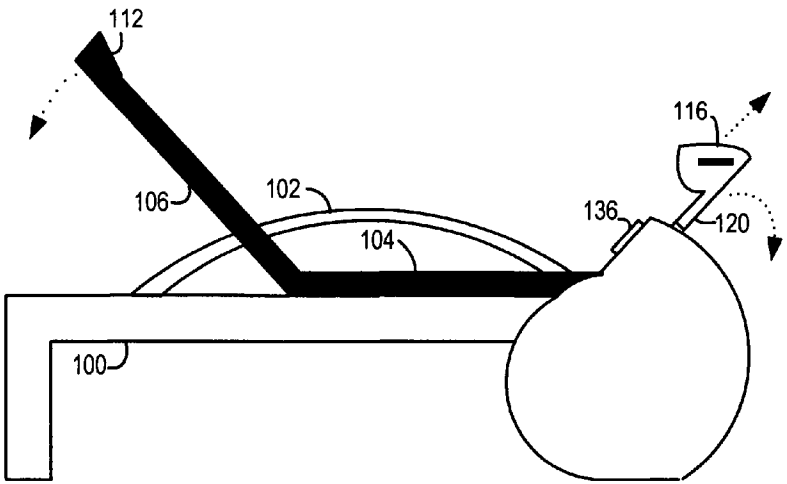
FIG. 1A is a side view of the Supine Elevation Cycle consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The Supine Elevation Cycle (SEC) features an extendable and adjustable elevated cycling device whereby the user exercises in a supine or reclined position while pedaling with the lower extremities positioned above the level of the heart. The SEC is uniquely designed to provide multiple levels of physical therapy, or if desired, vigorous cardiovascular exercise while minimizing painful physical impact on the body's major joints.

The principle of foot elevation above the heart promotes the physiological benefit of gravitational blood flow and transfers the weight bearing stress from major joints to the large muscles in the calves, thighs, abdomen and back, facilitating the return of more blood to the heart. This principal of activity reduces the risk of venous stasis, a condition where the vein's function in carrying blood back to the heart is compromised. In effect, the increase and efficiency of blood returned to the heart in turn increases cardiac output.

When in a seated position or in an up-facing supine position, the user may use the hands to operate the exercise operation mechanism, allowing the user to exercise the upper extremities. This upright posture and use of the upper extremities provides therapeutic exercise for the wrists, arms, shoulders and upper chest.

With an adjustable back support, the user, utilizing the extension and angling features of the cycling device, can target numerous muscle groups of the body and extremities. The magnetic resistance system in the exercise operation assembly affords a wide range of resistance options, from light stretching or controlled muscle therapy using minimal resistance to the most intense cardiovascular workout.

The angling and elevation aspect of the cycling device facilitates a dramatically different blood flow than traditional upright exercising where blood is pumped from the heart down into the legs and feet. When using the SEC, blood is pumped from the heart into arteries running through the legs to the feet. The blood then flows back through the veins to the heart. This venous blood flow return significantly improves circulation, sending more oxygen to the muscles, resulting in a more efficient blood delivery system.

The SEC provides major benefits to those who are wheelchair bound, or who are unable or are reluctant to use traditional equipment because of agility or stability issues. For example, lying in a supine or reclined position allows the user to exercise the core muscles and lower extremities.

In another example, sitting upright on the bench, and using the hands to operate the exercise operation mechanism, allows the user to exercise the upper extremities. This can be enormously beneficial to patients recovering from shoulder, elbow, and wrist surgeries. Furthermore, the user, laying in a fully supine position, face up, with the head proximal to the assembly shaft, the user can exercise with hands elevated above the head resulting in greatly improved venous flow from the upper extremities. Some of the beneficiaries of this position would be patients recovering from radical mastectomy who are prone to developing adhesion of the tissues in surgical area and muscle atrophy.

Turning now to FIG. 1A, in an exemplary embodiment the SEC is configured as a bench 100 suitable for use as an exercise platform upon which a user may grip an arm support 102 to raise or lower themselves to lie supine upon a bench pad 104 to engage in an exercise activity. The bench 104 is composed of an elongated pad that is of sufficient length to cover the entire top surface of the SEC bench 100. The bench pad 104 is configured such that a portion of the pad may be elevated to act as an adjustable back support 106, and includes a supporting head rest 108 incorporated into the upper surface of the bench pad 104. The supporting head rest 108 is of sufficient density and height to provide support to a human head while in a supine position upon the bench pad 104 and to minimize stress on the neck and shoulders of a user while exercising.

At one end of the bench 100 is a composite cover 112 that provides for isolation of portions of the SEC that need to be shielded from contact with the user, providing for a sleek appearance and functional protection both for the user and for physical elements of the SEC. At the same end of the bench 100 a exercise operation assembly 116 is attached to the bench 100 by inserting a exercise operation assembly shaft 120, to which the exercise operation assembly 116 is affixed at the upper end, through the composite cover. The exercise operation assembly 116 may in certain examples have user contact points that consist of peddles, handles, straps, or any other gripping device that may be used to provide motive force from the hands or feet of the user to the exercise operation assembly 116 of the apparatus. Subsequent exemplary description will use peddles as the preferred user contact element, however, this should in no way be considered as limiting the exercise operation assembly 116 to only a peddle contact element.

The exercise operation assembly 116 height above the bench 100 may be increased or decreased by lengthening the exercise operation assembly shaft 120 and fixing the shaft at the subsequent length through commands communicated from the user by inputting such commands upon the keypad of the information display 124 integrated into the composite cover 112. Removably affixed to the surface of the composite cover 112, the information display 124 with integral keypad is positioned to provide exercise parameter information on the display 124 such that the information is visible to a user in the process of using the exercise operation assembly 116. The integral keypad to the information display 124 allows a user to input parameters for metrics, repetitions, exercise parameters, commands for lengthening and rotating the exercise operation assembly shaft 120, and other information that is required for the best use of the equipment.

This figure presents the configuration of the SEC in which the exercise pad 104 is elevated to provide back support for those exercise functions that may be required when a user is sitting upright.

Figure 1B:
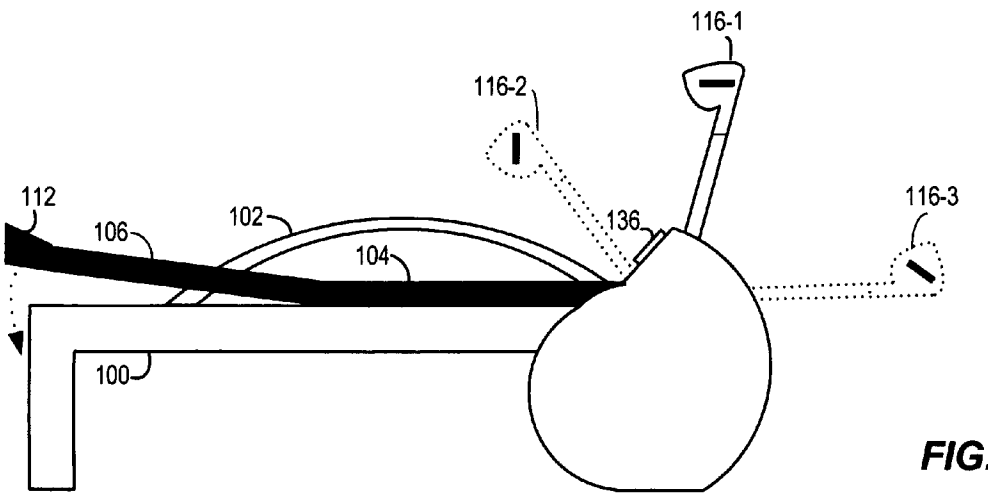
FIG. 1B is a side view of the Supine Elevation Cycle consistent with certain embodiments of the present invention.

Turning now to FIG. 1B, this figure presents alternative configurations of the bench pad 104, exercise operation assembly 116, and exercise operation assembly shaft 120 to support the multiple exercise capabilities of the SEC. In position 116-1 the exercise operation assembly shaft is lengthened to full extension to support the use of the bench for individual users with longer legs, or to provide a greater angle between the bench upon which the user lies supine and the exercise operation assembly position one 116-1. The user may also select any position for extension of the exercise operation assembly 116 by input of the desired length of the exercise operation assembly shaft from a 0% height adjustment to a 100% height adjustment to facilitate the exercise needs of the user.

In position 116-2, the exercise operation assembly 116 has been rotated forward from the position of 116-1 to form a position wherein the exercise operation assembly 116 extends over the bench pad 104. By way of example, position 116-2 may facilitate the use of the upper extremities in the exercise by allowing the user to grasp the exercise operation assembly 116 peddles with their hands and practice motions that will exercise the muscles of the hands, wrists, arms, shoulders and chest. Position 116-2 may also represent an angle forward of an initial starting position, represented by position 116-1 for the exercise operation assembly shaft 120. Angle measurements for the exercise operation assembly shaft 120 and their inclination from a relative position of 0 degrees will be described in a later section of this document. However, with regard to position 116-2, the selection of this relative position may be input on the keypad of the information display 124 as an angle measurement from 0 degrees to 140 degrees.

Position 116-3 presents the exercise operation assembly 116 at a relative position of 0 degrees of inclination relative to the bench pad 104, and with full extension of 100% selected on the information display 124. This position presents yet another example of an exercise position that a user may select to facilitate rehabilitative motion or exercise motion. In this position, the user may either be seated upon the bench 100, lie face-down, or lie supine upon the bench 100 and extend their legs past the composite cover 112 to reach the exercise operation assembly 116. This position provides the greatest extent of the exercise operation assembly 116 to facilitate more intense exercise activity for the user.

Figure 2:
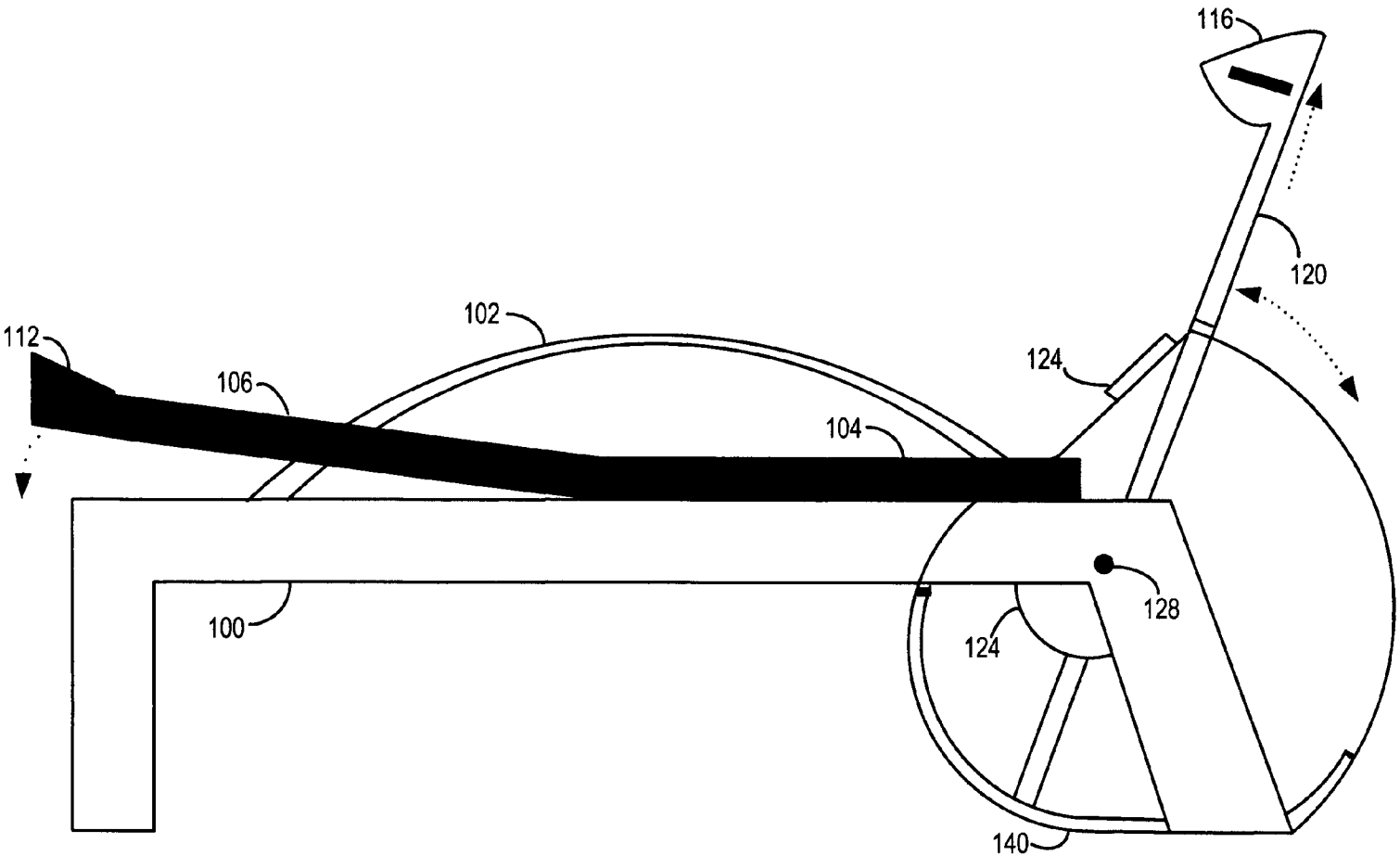
FIG. 2 is a side view with adjustment of certain elements of the Supine Elevation Cycle consistent with certain embodiments of the present invention.

Turning now to FIG. 2, this figure presents an exemplary embodiment of the SEC with the composite cover 112 in cut-away view. The end of the bench 100 which is enclosed by the composite cover 112 includes the mechanism for the attachment and adjustment of the exercise operation assembly 116 by manipulating the position of the exercise operation assembly shaft 120. In this example embodiment, the exercise operation assembly shaft 120 passes through a motor assembly 126 that is responsible for adjusting both the angle of the exercise operation assembly shaft 120 with respect to the surface plane of the bench 100 and the length of the exercise operation assembly shaft 120. The motor assembly 126 may be assembled of gears and electrical motors as are known in the art and will not be further discussed in this disclosure. The motor assembly 126 is attached to the end of the bench 100 by use of an attachment axle 128 that extends through the legs of the bench 100 and provides a secure mounting shaft for the motor assembly 126 without interfering with adjustment motions of the exercise operation assembly shaft 120.

Modifying the position of the exercise operation assembly shaft 120 is accomplished by the motor assembly 126 moving the exercise operation assembly shaft 120 in a radial fashion. This movement is facilitated by the distal end of the exercise operation assembly shaft 120 being interconnected to a shaft end track 140 that is arc-shaped and attached to the inside bottom of the composite cover 112 such that the distal end of the exercise operation assembly shaft 120 moves along the arc of the exercise operation assembly shaft track 140 and may be positioned at any point along the exercise operation assembly shaft track 140. In an alternative embodiment, the exercise operation assembly shaft track 140 may be separate from the composite cover 112 and be attached directly to the bench 100 at any desired attachment points and by any known attachment device. Modifying the length of the exercise operation assembly shaft 120 brings the exercise operation assembly 116 either closer or further from the surface plane of the bench 100 and provides adjustment to accommodate both the varying physical parameters of the user and the exercise regimen of the user.

In this exemplary embodiment, the motor assembly 126 receives instruction regarding positioning of the exercise operation assembly shaft 120 from the input keypad of the information display 124. The instructions that a user may enter include the angle at which to position the exercise operation assembly shaft 120 in relation to the surface plane of the bench 100, and the length of the exercise operation assembly shaft 120 in relation to the distance from the top edge of the composite cover 112. For adjustment purposes, when the exercise operation assembly shaft 120 is positioned such that it is fully parallel with the surface plane of the bench 100 (see position 116-3 of FIG. 1B) the exercise operation assembly shaft 120 is said to be at 0 degrees of arc.

With the user lying in a fully reclined position on the bench pad 104, and the exercise operation assembly shaft 120 being fully horizontal and parallel to the bench 100 at 0 degrees, the range of arc of the exercise operation assembly shaft, turning counter-clockwise, can achieve cycling positions between 0 and 140 degrees. In an exemplary embodiment, at the initial position of 0 degrees relative to the surface plane of the bench 100, a user lying on the bench pad 104 would find their legs extended straight out beyond the end of the bench 100 to reach the exercise operation assembly 116 positioned parallel with the bench. Continuing the exemplary embodiment, by moving the assembly shaft 120 through 90 degrees of arc along the exercise operation assembly shaft track 140, a user lying supine on the bench 100 would place their feet onto the peddles of the exercise operation assembly 116 directly above the bench 100 so as to form a 90 degree angle between the legs and the body of the user. In another exemplary embodiment, if required the exercise operation assembly shaft 120 may move through an additional 50 degrees of arc along the exercise operation assembly shaft track 140 to place the exercise operation assembly 116 at 140 degrees of arc relative to the starting position of 0 degrees when the exercise operation assembly shaft 120 is parallel to the bench 100. The exercise operation assembly shaft 120 may thus move through a range from 0 to approximately 140 degrees of arc along the exercise operation assembly shaft track 140 to provide for a broad range of positions to assist users in both exercise and therapeutic movements.

In a further aspect of the exemplary embodiment, in addition to the adjustment of the exercise operation assembly 116 position along the exercise operation assembly shaft track 140, the exercise operation assembly 116 may be positioned at varying heights above the bench 100 by elongating the exercise operation assembly shaft 120. A height position of 0% may be established as the point at which the exercise operation assembly 116 is positioned at its closest approach to the composite cover 112, and a height position of 100% may be established as the point at which the exercise operation assembly 116 is positioned at its furthest distance from the composite cover 112. Other methods of marking relative position of the exercise operation assembly in terms of distance from the bench 100 may be contemplated and used, as long as the regime properly accounts for the full extension and compression of the length of the exercise operation assembly shaft 120 and is properly programmed into the processor that drives the information display 124 for use in apparatus adjustment. The height adjustment of the exercise operation assembly 116 may be accomplished by lengthening and shortening the exercise operation assembly shaft 120 through the action of the motor assembly 124. This combination of motion along the arc of the exercise operation assembly shaft track 140 and height adjustment through the use of the motor assembly 124 provides for both angle and elevation adjustment of the exercise operation assembly 116.

The angle and elevation adjustment of the exercise operation assembly 116 relative to the bench 100 facilitates a dramatically different blood flow than traditional upright exercising activities where blood is pumped from the heart down into the legs and feet. When using the SEC, a user or patient may either lie prone or supine upon the bench pad 104. When lying supine on the bench pad 104, the angle of the back support 106 may be adjusted to provide the greatest comfort and facilitate the action of using the exercise operation assembly 116. In action, blood is pumped up the legs and, when reaching the feet, blood flows back down the legs in to the heart. Relative to the position of traditional peddle devices, this significantly increased blood flow, generated by a more efficient venous return, results in greater cardiac output, sending more oxygen to the muscles, tissues and major organs of the body.

Figure 3:
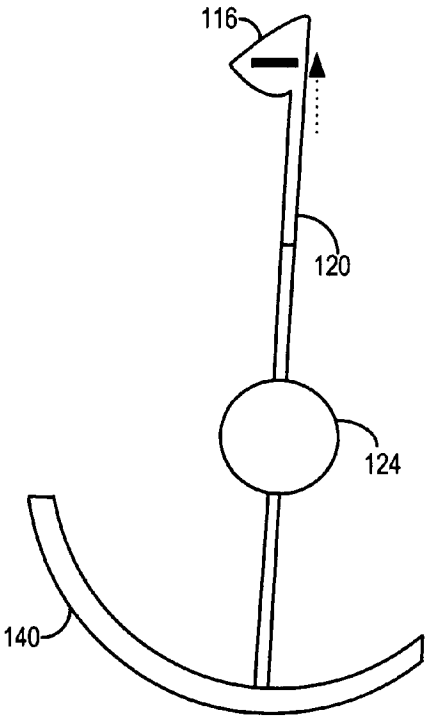
FIG. 3 is an isolated view of the exercise operation assembly and exercise operation assembly adjustment apparatus consistent with certain embodiments of the present invention.

Turning now to FIG. 3, the figure presents an isolated view of the exercise operation assembly 116 and associated movement portions. The exercise operation assembly 116 is an integral portion of the top end of the exercise operation assembly shaft 120, and the distal end of the exercise operation assembly shaft 120 is connected to the exercise operation assembly shaft track 140 by a shaft end block. The exercise operation assembly shaft 120 is a shaft manufactured in at least two sections such that the length of the shaft may be changed, either lengthening or shortening the length, at the command of the user. The exercise operation assembly shaft 120 sections a combined within the motor assembly 124 in a sufficient manner to accommodate the variations in height without interfering in the use of the apparatus. The motor assembly 124 may be contained within a housing and may have motorized elements that provide for both the extension of the exercise operation assembly shaft 120 and provide for changing the arc of the assembly from a 0 degree position, which represents the position in which the exercise operation assembly shaft 120 is parallel to the floor, to the maximum angular displacement allowed by the exercise operation assembly shaft track 140. In an exemplary embodiment, this angular displacement may be at least 140 degrees relative to the 0 degree position of the exercise operation assembly shaft 120. The motor assembly 124 may be operative move the exercise operation assembly to a desired height and position by both lengthening the exercise operation assembly shaft 120 and moving the position of the exercise operation assembly by positioning the exercise operation assembly shaft 120 along the arc length of the exercise operation assembly shaft track 140.

Figure 4:
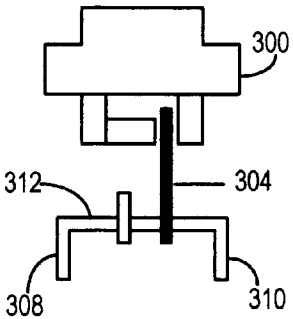
FIG. 4 is an internal view of the mechanism of the exercise operation assembly consistent with certain embodiments of the present invention.

Turning now to FIG. 4, the figure presents a view of an exemplary internal assembly for the exercise operation structure to be used in both the exercise and therapeutic modes of the SEC. In the present exemplary embodiment, the internal structure of the assembly may be composed of a magnetic resistance device 300 which presents a variable resistance force by increasing and decreasing magnetic field acting upon a magnetic resistance wheel 304. However, it will be understood that the resistance device that provides resistance in the exercise operations may, in other exemplary embodiments, may consist of friction wheels, straps, or any other adjustable resistance device that may be connected to the exercise assembly. For purposes of example and not by way of limitation, the magnetic resistance wheel 304 is attached to the peddles (308, 310) of the assembly via an axle 312. The user may set the magnetic field of the magnetic resistance device 300 to a desired level to achieve the maximum effect for either exercise or therapeutic activity. The magnetic resistance in the magnetic resistance device affords a wide range of cycling resistance, from light stretching or controlled muscle therapy, to the most intense cardiovascular workout.

Figure 5:
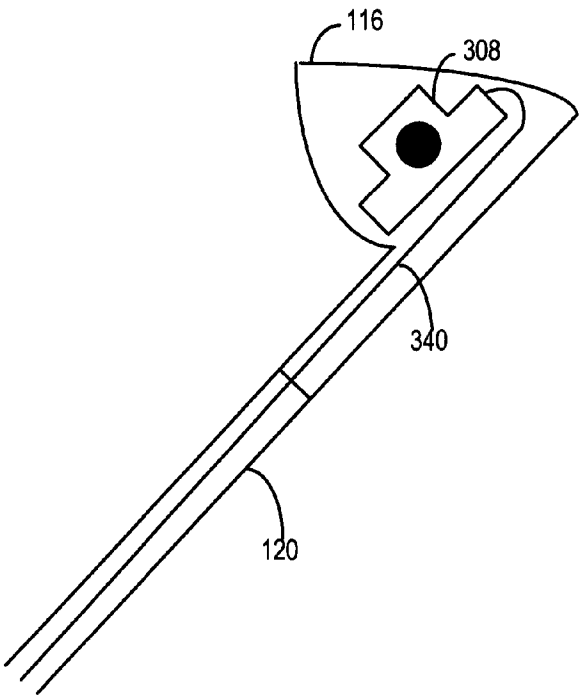
FIG. 5 is a cutaway view of the exercise operation assembly and exercise operation assembly shaft presenting command and control cables consistent with certain embodiments of the present invention.

Turning now to FIG. 5, the figure presents a cutaway view of the interior of the exercise operation assembly 116 and the exercise operation assembly shaft 120. In this view, the peddle 308 and its connection to the information display 132 may be seen to be connected. The connection is accomplished in a non-limiting example by the use of a magnetic resistance device (MRD) cable 340 that carries exercise activity information from the exercise operation assembly 116 to the information display processor (not shown). A second communication cable 340 transmits command and control information from the keypad 132 to the motor assembly (not shown).

Figure 6:
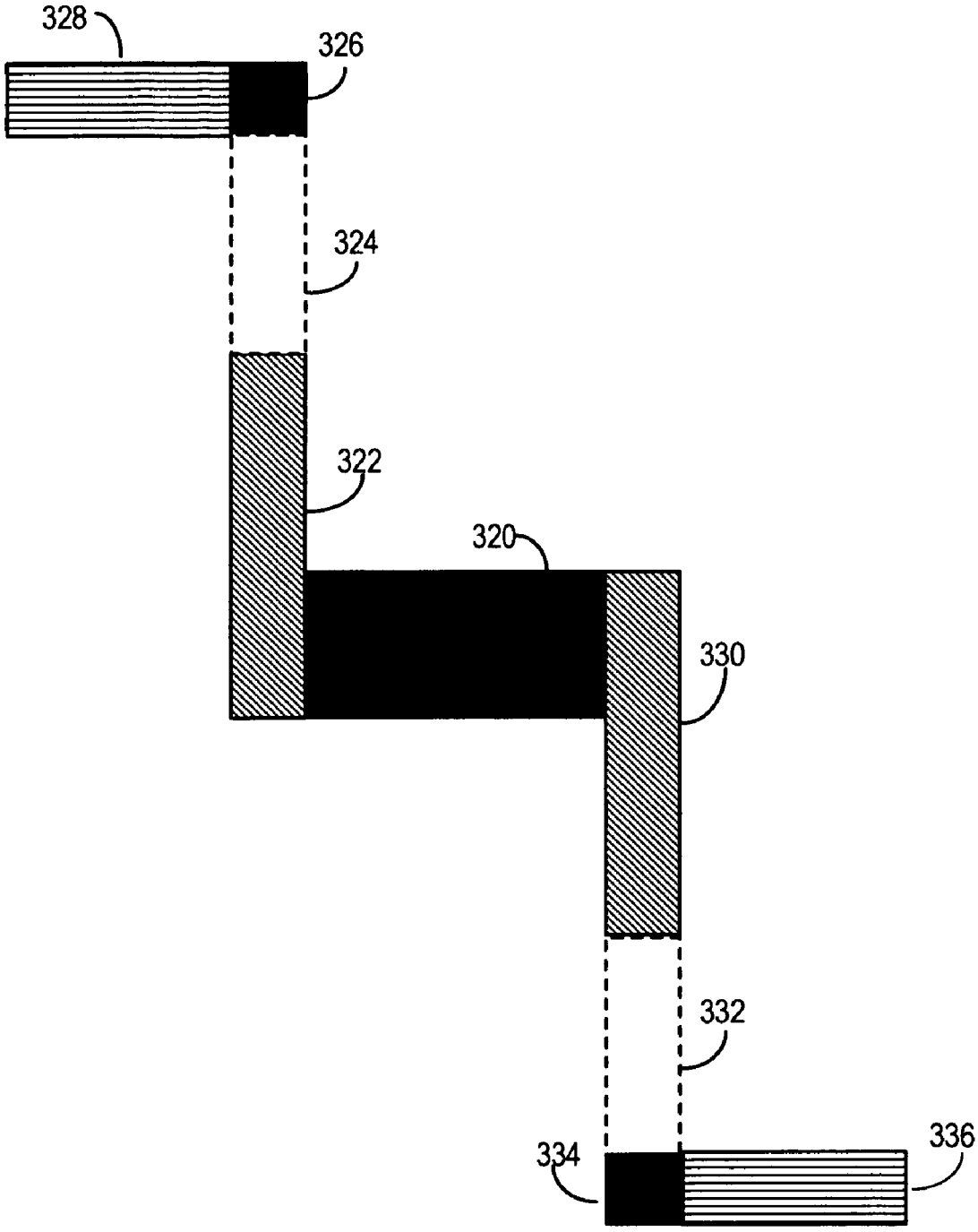
FIG. 6 is a view of the extension mechanism of the exercise operation assembly consistent with certain embodiments of the present invention.

Turning now to FIG. 6, this figure presents an exemplary configuration for an exercise assembly in which the assembly may be connected to the exercise apparatus through an inner-connecting gear having an external adjustment lever in which may be adjusted through extension. The extension of the mechanical push devices of the assembly provide for greater ranges of motion and better adjustment of the push devices to fit the user of the apparatus. In this exemplary configuration, a center axle 320 is connected to the exercise apparatus. A left handle crank shaft 322 and a right handle crank shaft 330 extend from the left and right ends of the center axle 320. The left handle crank shaft 322 and the right handle crank shaft 330 are threaded internally with grooves that constitute an internal screw structure extending substantially the entire length of the handle crank shafts. An externally threaded left crank shaft extension 324 and right crank shaft extension 332 are manufactured with a sufficient diameter to screw into the left handle crank shaft 322 and right handle crank shaft 330 respectively. When fully screwed into the handle crank shafts, the crank shaft extensions are not visible and the left peddle attachment block 326 and left peddle 328 and the right peddle attachment block 334 and right peddle 336 are at their closest approach to the center axle 320. As the user rotates each extension, the screw threading causes the extension to emerge from the handle crank and move the peddle further away from the center axle until a desired extension distance is reached. Each crank shaft extension is separately adjustable to form even extension from the center axle, or to allow each peddle to be located at a different distance from the center axle. Although this implementation is presented with a peddle connected to the extension end of each crank shaft extension, it should be readily apparent than any sort of exercise operation device, such as a strap or handle, may be used instead of a peddle and that the peddle used in this description is as a non-limiting example only.

Figure 7:
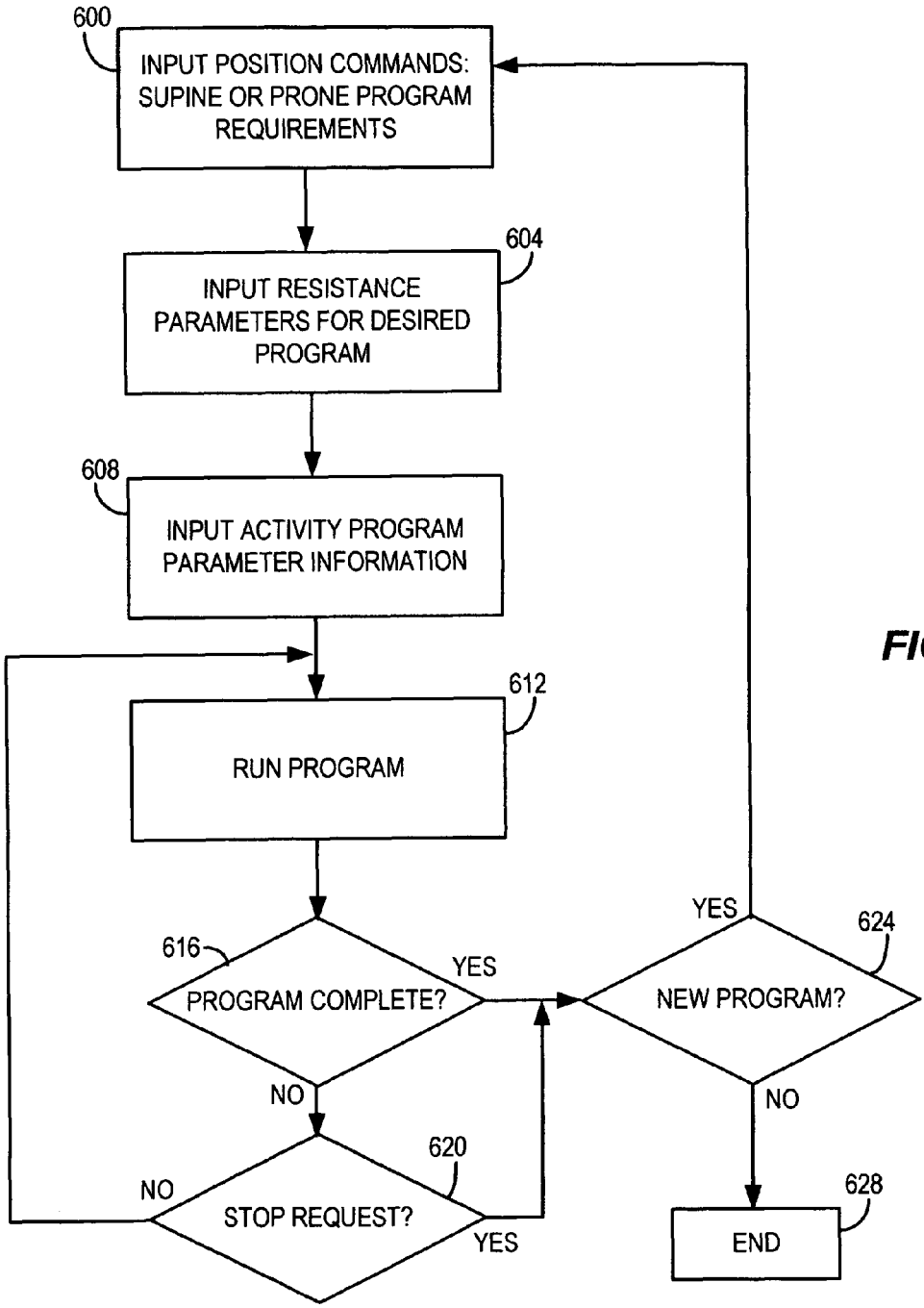
FIG. 7 is a description of activity methodology consistent with certain embodiments of the present invention.

Turning now to FIG. 7, this figure presents an exemplary method for therapeutic and exercise activity actions of the SEC involving the lower extremities. In a non-limiting example for exercise performance, a user may initiate the action of using the SEC by inputting the requirements for an exercise or therapeutic session, in either a supine or prone user configuration 600. The user may then input the desired resistance parameter information for the peddle resistance for the given program 604 by entering the desired positional information and the exercise parameter information using the integrated keypad. The user may then input the activity parameters, such as duration or any other program related command parameters desired 608 and begin the session 612.

If the program is interrupted, the SEC first interrogates the user to determine if the program is complete 616. If the program desired by the user has been completed successfully, the user will be asked if they would like to input the parameters for a new program session 624. If the user responds in the affirmative, the SEC will once again accept input at 600. However, if the user is done the SEC will stop the program at 628.

If there is an interruption in which the user indicates that the program is being terminated as the result of a stop request 620, the SEC will determine once again if the user requested the interruption. If the user indicates that the program was stopped inadvertently for any reason, the program will resume operation at 612. If the user indicates that the program was terminated intentionally, the SEC will inquire whether the user would like to initiate a new program 624. If the user responds in the affirmative, the SEC will once again accept input at 600. If the user responds in the negative, the SEC will stop the program at 628.

An optional feature includes a memory program that would store objective data of the patient's performance history for monitoring of the patients progress or performance history.

Figure 8:
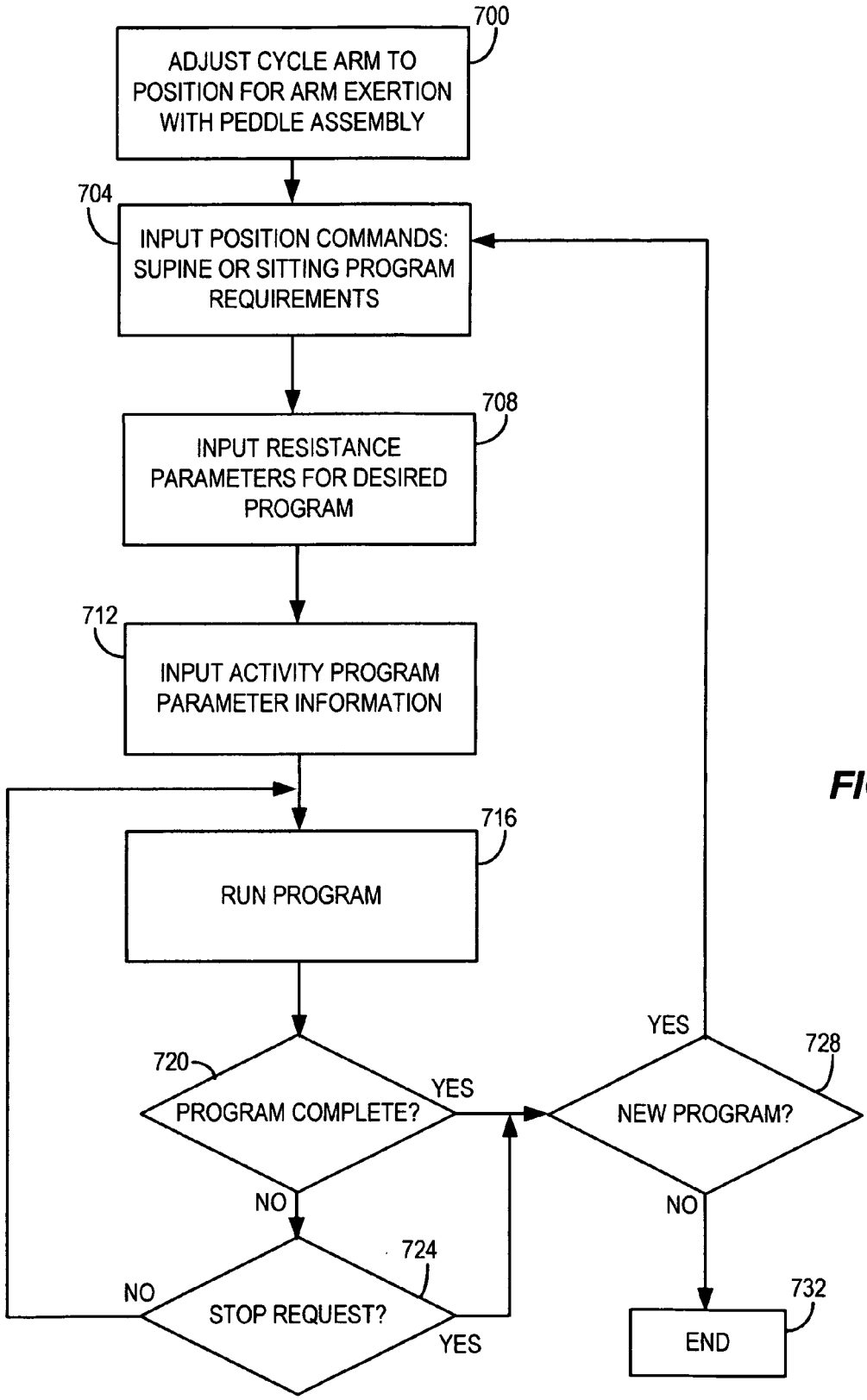
FIG. 8 is a description of supine or sitting activity methodology consistent with certain embodiments of the present invention.

Turning now to FIG. 8, this figure presents an exemplary method for therapeutic and exercise activity actions of the SEC for the upper extremities. In a non-limiting example in exercise performance, a user may initiate the action of using the SEC by inputting the requirements for an exercise or therapeutic session using the upper extremities 700. The user enters information to adjust the apparatus to accommodate either a supine, face-up or upright configuration 700 in which the user will operate the peddles with their hands. The user may then input the desired resistance parameter information for the exercise operation resistance for the given program 708 by entering the desired positional information and the exercise parameter information using the integrated keypad. The user may then input the activity parameters, such as duration or any other program related command parameters desired 712 and begin the session 716.

If the program is interrupted, the SEC first interrogates the user to determine if the program is complete 720. If the program desired by the user has been completed successfully, the user will be asked if they would like to input the parameters for a new program session 728. If the user responds in the affirmative, the SEC will once again accept input at 704. However, if the user is done the SEC will stop the program at 732.

If there is an interruption in which the user indicates that the program is being terminated as the result of a stop request 724, the SEC will determine once again if the user requested the interruption. If the user indicates that the program was stopped inadvertently for any reason, the program will resume operation at 716. If the user indicates that the program was terminated intentionally, the SEC will inquire whether the user would like to initiate a new program 728. If the user responds in the affirmative, the SEC will once again accept input at 704. If the user responds in the negative, the SEC will stop the program at 732.

An optional feature includes a memory program that would store objective data of the patient's performance history for monitoring of the patients progress or performance history.

Figure 9:
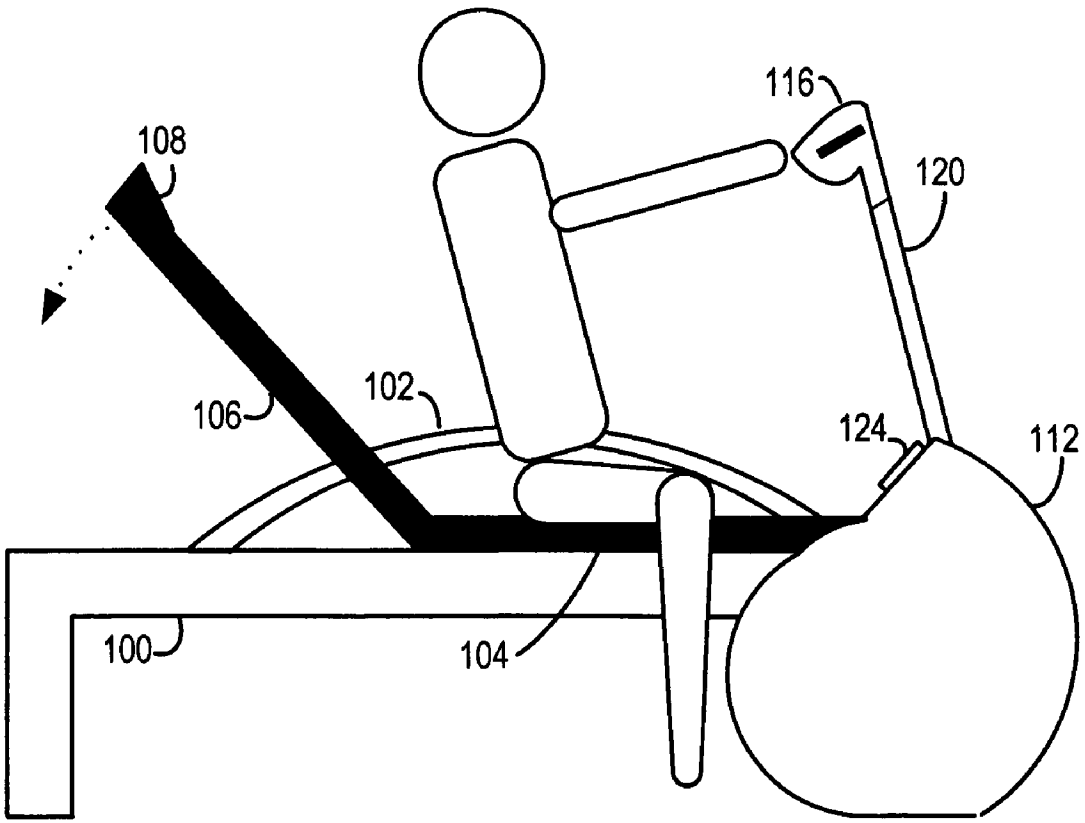
FIG. 9 is a view of activity methodology of the exercise operation assembly consistent with certain embodiments of the present invention.

Turning now to FIG. 9, this figure presents an example view of the use of the apparatus for a person in an upright, sitting position. In this position, the user may adjust the exercise operation assembly shaft 120 to bring the exercise operation assembly into a range where the user may operate the peddles with their hands. The range of motion for this exercise may be changed by adjusting the angle of the exercise operation assembly shaft 120 in relation to the surface plane of the bench 100. Increasing the angle of the exercise operation assembly shaft 120 will bring the exercise operation assembly 116 in closer proximity to the bench 100, and decreasing the angle will move the exercise operation assembly 116 further away from the surface of the bench 100. Exercises in this position may be used to strengthen or provide therapeutic motion for the hands, wrists, elbows, shoulders, chest, and back. Adjustment of the exercise operation assembly shaft 120 provides ranges of motion to allow for the concentration of various groups of muscles in the arms, shoulders, and chest.

Figure 10:
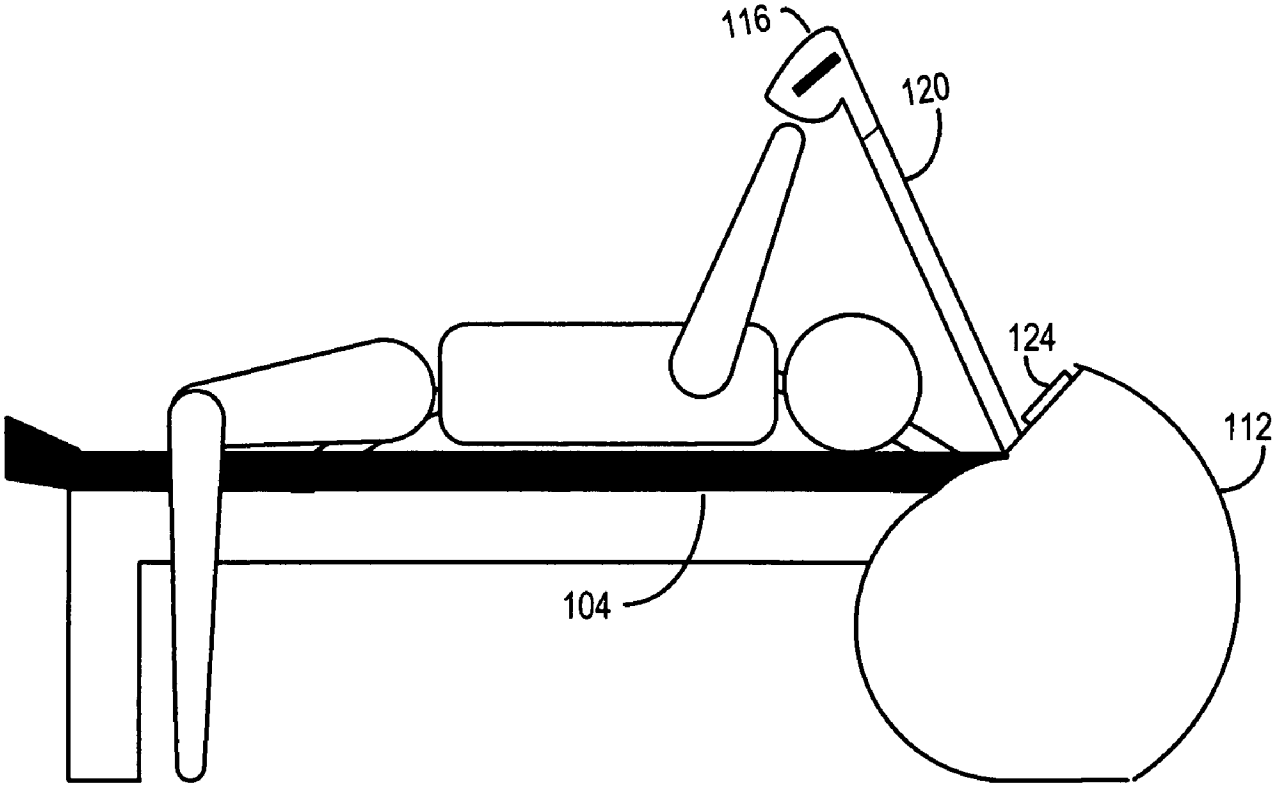
FIG. 10 is view of activity methodology of the exercise operation assembly consistent with certain embodiments of the present invention.

Turning now to FIG. 10, this figure presents an example view of the use of the apparatus for a person in a supine, face-up position. In this position, the user may adjust the exercise operation assembly shaft 120 to bring the exercise operation assembly into a range where the user may operate the peddles with their hands. The range of motion for this exercise may be changed by adjusting the angle of the exercise operation assembly shaft 120 in relation to the surface plane of the bench 100. Increasing the angle of the exercise operation assembly shaft 120 will bring the exercise operation assembly 116 in closer proximity to the bench 100, and decreasing the angle will move the exercise operation assembly 116 further away from the surface of the bench 100. Exercises in this position may be used to strengthen or provide therapeutic motion for the hands, wrists, elbows, shoulders, chest, and back. Adjustment of the exercise operation assembly shaft 120 provides ranges of motion to allow for the concentration of various groups of muscles in the upper extremities, back and chest.

Figure 11:
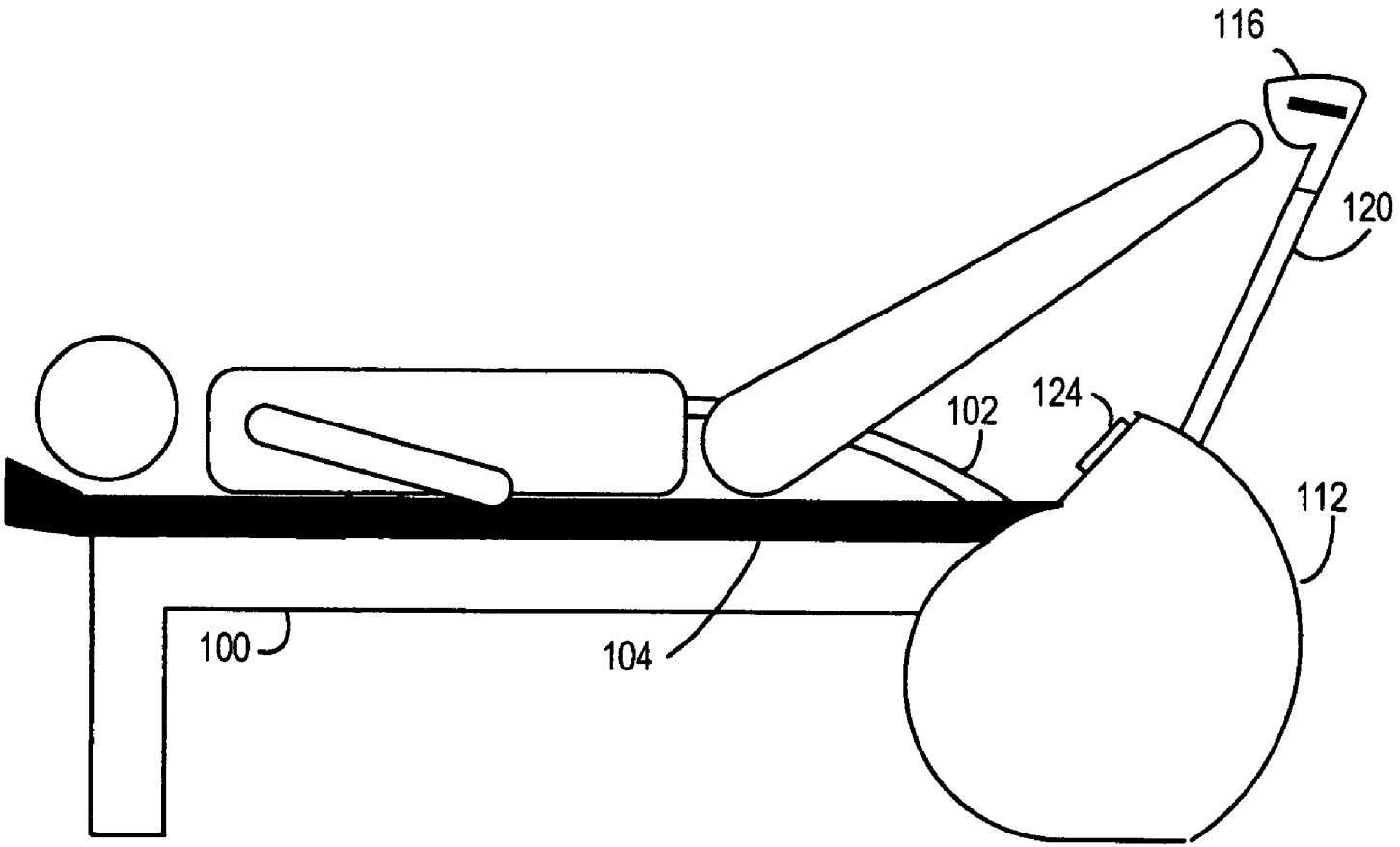
FIG. 11 is view of activity methodology of the exercise operation assembly consistent with certain embodiments of the present invention.

Turning now to FIG. 11, this figure presents an example view of the use of the apparatus for a person in a supine, face-up position with the head positioned at the far end of the bench 100, away from the exercise operation assembly 116. In this position, the user may adjust the exercise operation assembly shaft 120 to bring the exercise operation assembly into a range where the user may operate the peddles with their feet. The range of motion for this exercise may be changed by adjusting the angle of the exercise operation assembly shaft 120 in relation to the surface plane of the bench 100. Increasing the angle of the exercise operation assembly shaft 120 will bring the exercise operation assembly 116 in closer proximity to the bench 100, and decreasing the angle will move the exercise operation assembly 116 further away from the surface of the bench 100. The user may also grip the arm support 102 for additional support during active use of the apparatus. Exercises in this position may be used to strengthen or provide therapeutic motion for the feet, ankles, knees, hips, and waist, as well as the muscles of the legs. Adjustment of the exercise operation assembly shaft 120 provides ranges of motion to allow for the concentration of various groups of muscles in the legs, back and abdomen.

By way of example, users with arthritic conditions may experience significant comfort improvement through reduced impact on knee, ankle and foot joints. FIGS. 8-10 are by way of example of user positions upon the apparatus and the beneficial effects from such positions. They are in no way intended to present an exhaustive list of all of the positions a user may assume upon the apparatus, or the beneficial positions that may be attained through adjustment of the exercise operation assembly shaft 120 in combination with such user positions when using the apparatus.

By way of further example, individuals who suffer from Venous Stasis of the lower extremities and venous insufficiency may experience improved venous return from the feet and legs back to the heart, reducing the likelihood of blood pooling in the legs, and consequently, the risk of venous congestion through the use of the SEC in supine programs where the feet are elevated to reach the peddles, such as the position shown in FIG. 11. Chronic venous stasis can lead to leg edema and skin ulceration, which in turn can result in systemic infection. The reverse blood produced by elevated cycling reduces the risk of venous congestion, allowing the veins to more quickly recover elasticity to the walls of the veins, improving efficiency of the veins valves. Prevention of venous congestion of the lower extremities can help reduce or prevent the formation of venous stasis, leading to cellulitis.

Additional conditions that may be improved through the use of the SEC include:

1. Patients with mild to moderate congestive heart failure:

Upon clearance by a cardiologist to engage in mild exercise, the antigravity aspects of elevated cycling allows for improved venous return which in turn increases the "cardiac preload", or cardiac filling, improving cardiac output and ejection fraction.

2. Neurological and muscular disorders:

Parkinson's and Multiple Sclerosis patients are often precluded from using traditional exercise equipment due to stability and balance issues. The SEC's supine workout position allows them to perform aerobic exercise safely with intermittent and frequent rest without having to leave the device.

3. Postoperative Rehabilitation of the major joints:

The minimal impact and resistance features of the SEC allow the patient to more quickly return to mild exercise, preventing atrophy of the muscles due to lack of use during the convalescent phase of recovery.

4. Cancer and Auto-Immune diseases such as Lupus and Rheumatoid Arthritis.

These patients are often discouraged from engaging in moderate to high impact exercising because of strength or stability concerns. The supine features of the SEC and low impact of the adjustable elevated cycling device provide confidence and full control by the patient.

5. Pulmonary Disease:

Patients with limited functional capacity due to shortness of breath can improve their function by starting with upper extremity conditioning and strengthening with the arm cycle eventually advancing to the supine position and exercise of the lower extremities.

While certain illustrative embodiments have been described, it is evident that many alternatives, modifications, permutations and variations will become apparent to those skilled in the art in light of the foregoing description.

What is claimed is:

1. A therapeutic exercise device, comprising:

a bench;

an extendible shaft with a first end and a second end;

an exercise operation assembly mounted on the first end of the extendible shaft;

the extendible shaft attached to an end of the bench using an axle affixed to the bench, operative to rotate the shaft around the fixed position of the axle;

the second end of the extendible shaft mounted within an arc-shaped channel, operative to move freely along the arc-shaped channel;

a motor controlled assembly affixed to the shaft and to the axle operative to rotate the extendible shaft such that the extendible shaft rotates through a pre-determined arc, maintaining the resultant position as commanded from a user input;

the motor controlled assembly is also operative to extend and retract the length of the extendible shaft;

the extendible shaft movable to position the attached exercise operation assembly attached to the first end of the shaft in the desired position for therapeutic exercise activity operations.

2. A therapeutic exercise device as in claim 1, wherein the exercise operation assembly comprises a resistance component and a movable component that is movable against the resistance provided by the resistance component.

3. A therapeutic exercise device as in claim 2, wherein the movable component comprises a peddle assembly, a handle assembly, or a strap assembly configured to move when pushed or pulled by a user.

4. A therapeutic exercise device as in claim 2, wherein the resistance component comprises a magnetic, friction, or electromagnetic resistance devices operatively connected to the movable component.

5. A therapeutic exercise device as in claim 1, further comprising a shaft end block that connects the end of the extendible shaft into the arc-shaped channel and maintains the shaft end securely within the arc-shaped channel as the shaft moves along the arc of the arc-shaped channel.

6. A therapeutic exercise device as in claim 1, wherein the arc-shaped channel is of sufficient arc length to provide for the positioning of the movable shaft from a position of 0 degrees through a position of 140 degrees relative to a plane of the top surface of the bench.

7. A therapeutic exercise device as in claim 1, wherein the bench further comprises a pad that is adjustable to provide support for users in sitting, supine, and face-up reclining positions.

8. A therapeutic exercise device as in claim 1, further comprising:

a motor assembly housing that encloses the motor assembly;

the motor assembly housing is affixed to the axle and the movable shaft passes through the motor assembly housing normal to a plane of the top surface of the bench.

9. A therapeutic exercise apparatus, comprising:

a bench comprising an extendible shaft with a first end and a second end and a padded upper surface to support a user during operation;

an exercise operation assembly mounted on the first end of the extendible shaft;

the extendible shaft attached to an end of the bench using an axle affixed to the bench, operative to rotate the shaft around the fixed position of the axle;

the second end of the extendible shaft mounted within an arc-shaped channel, operative to move freely along the arc-shaped channel;

a user input keypad operable to enter position and adjustment information commands;

a motor controlled assembly affixed to the shaft and to the axle operative to rotate the extendible shaft such that the extendible shaft rotates through a pre-determined arc, maintaining the resultant position as commanded from the user input keypad;

the motor controlled assembly is also operative to extend and retract the length of the extendible shaft;

the extendible shaft movable to position the attached exercise operation assembly attached to the first end of the shaft in the desired position for therapeutic exercise activity operations.

10. A therapeutic exercise apparatus as in claim 9, wherein the exercise operation assembly comprises a resistance component and a movable component that is movable against the resistance provided by the resistance component.

11. A therapeutic exercise apparatus as in claim 10, wherein the movable component comprises a peddle assembly, a handle assembly, or a strap assembly configured to move when pushed or pulled by a user.

12. A therapeutic exercise apparatus as in claim 10, wherein the resistance component comprises a magnetic, friction, or electromagnetic resistance devices operatively connected to the movable component.

13. A therapeutic exercise apparatus as in claim 9, further comprising a shaft end block that connects the end of the extendible shaft into the arc-shaped channel and maintains the shaft end securely within the arc-shaped channel as the shaft moves along the arc of the arc-shaped channel.

14. A therapeutic exercise apparatus as in claim 9, wherein the arc-shaped channel is of sufficient arc length to provide for the positioning of the movable shaft from a position of 0 degrees through a position of 140 degrees relative to a plane of the top surface of the bench.

15. A therapeutic exercise apparatus as in claim 9, wherein the bench further comprises a pad that is adjustable to provide support for users in sitting, supine, and face-up reclining positions.

16. A therapeutic exercise apparatus as in claim 9, further comprising:

a motor assembly housing that encloses the motor assembly;

the motor assembly housing is affixed to the axle and the movable shaft passes through the motor assembly housing normal to a plane of the top surface of the bench.

17. A system to facilitate therapeutic exercise motion, comprising:

a bench with a moveable and extendible shaft attached to one end of the bench by a fixed axle around which the extendible shaft rotates and maintains a pre-selected position;

an exercise operation assembly mounted on the first end of the extendible shaft;

the second end of the extendible shaft mounted within an arc-shaped channel, operative to move freely along the arc-shaped channel;

a user input keypad operable to enter position and adjustment information commands;

the extendible shaft positioning the exercise operation assembly in a position to provide for therapeutic and exercise motions utilizing the exercise operation assembly;

the position and extension of the extendible shaft modifiable through user input on the user input keypad to present a program of therapeutic and exercise actions and motions designed to assist in strengthening and healing programs prescribed for an individual user.

18. A system to facilitate therapeutic exercise motion as in claim 17, further comprising:

an exercise operation assembly comprising a resistance component and a movable component that is movable against the resistance provided by the resistance component;

the movable component comprising a peddle assembly, a handle assembly, or a strap assembly configured to move when pushed or pulled by a user; and the resistance component comprises a magnetic, friction, or electromagnetic resistance devices operatively connected to the movable component.

19. A system to facilitate therapeutic exercise motion as in claim 17, further comprising:

a shaft end block that connects the end of the extendible shaft into the arc-shaped channel and maintains the shaft end securely within the arc-shaped channel as the shaft moves along the arc of the arc-shaped channel; and the arc-shaped channel of sufficient arc length to provide for the positioning of the movable shaft from a position of 0 degrees through a position of 140 degrees relative to a plane of the top surface of the bench.

20. A system to facilitate therapeutic exercise motion as in claim 17, further comprising:

a programmable resistance regimen entered using the input keypad wherein the resistance of the resistance component of the exercise operation assembly changes to suit a pre-determined therapeutic or exercise program.

* * * * *